US009031263B1

(12) United States Patent
Chen

(10) Patent No.: US 9,031,263 B1
(45) Date of Patent: May 12, 2015

(54) LOUDSPEAKER

(71) Applicant: Zhongshan Innocloud Intellectual Property Services Co., Ltd., Zhongshan (CN)

(72) Inventor: Chih-Hua Chen, New Taipei (TW)

(73) Assignee: Zhongshan Innocloud Intellectual Property Services Co., Ltd., Zhongshan (CN)

( * ) Notice: Subject to any disclaimer, the term of this patent is extended or adjusted under 35 U.S.C. 154(b) by 0 days.

(21) Appl. No.: 14/095,883

(22) Filed: Dec. 3, 2013

(30) Foreign Application Priority Data

Nov. 8, 2013 (TW) ..... 102140620 A

(51) Int. Cl.
*H04R 25/00* (2006.01)
*H04R 1/02* (2006.01)

(52) U.S. Cl.
CPC ..... *H04R 1/02* (2013.01)

(58) Field of Classification Search
USPC ..... 381/87, 332, 334, 336, 386, 387, 390, 381/395; 181/150, 155, 156, 199; 248/176.1, 177.1, 222.52, 288.11
See application file for complete search history.

(56) References Cited

U.S. PATENT DOCUMENTS

| | | | | |
|---|---|---|---|---|
| 8,259,965 | B2 * | 9/2012 | Chen | 381/160 |
| 8,559,666 | B2 * | 10/2013 | Shibata | 381/395 |
| 2014/0072160 | A1 * | 3/2014 | Peacock | 381/336 |

* cited by examiner

*Primary Examiner* — Huyen D Le
(74) *Attorney, Agent, or Firm* — Novak Druce Connolly Bove + Quigg LLP

(57) ABSTRACT

A loudspeaker includes a base, a sound-reflecting member located at a side of the base, a sound generator mounted to the sound-reflecting member, an adjusting member including a number of magnetic pieces and located at an opposite side of the base, a connecting member connected between the sound-reflecting member and the adjusting member, a supporting member, and a controlling apparatus. The supporting member includes a number of first electromagnets mounted to the magnetic pieces. The controlling apparatus is electrically coupled to the first electromagnets. The controlling apparatus controls the first electromagnets to attract the magnetic pieces, to allow the adjusting member to swing, and the adjusting member drives the connecting member to rotate, thereby swinging the sound-reflecting member.

16 Claims, 6 Drawing Sheets

LOUDSPEAKER

BACKGROUND

1. Technical Field

The present disclosure generally relates to a loudspeaker.

2. Description of Related Art

Sound broadcasted by loudspeakers travels in all directions. However, the sound may not be heard equally clearly by people at different locations, and a conventional loudspeaker can not adjust itself towards a listener at a different locations. Therefore, there is room for improvement in the art.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of examples and not by way of limitation. It should be noted that references to "an" or "one" embodiment in this disclosure are not necessarily to the same embodiment, and such references mean "at least one."

Figure 1:
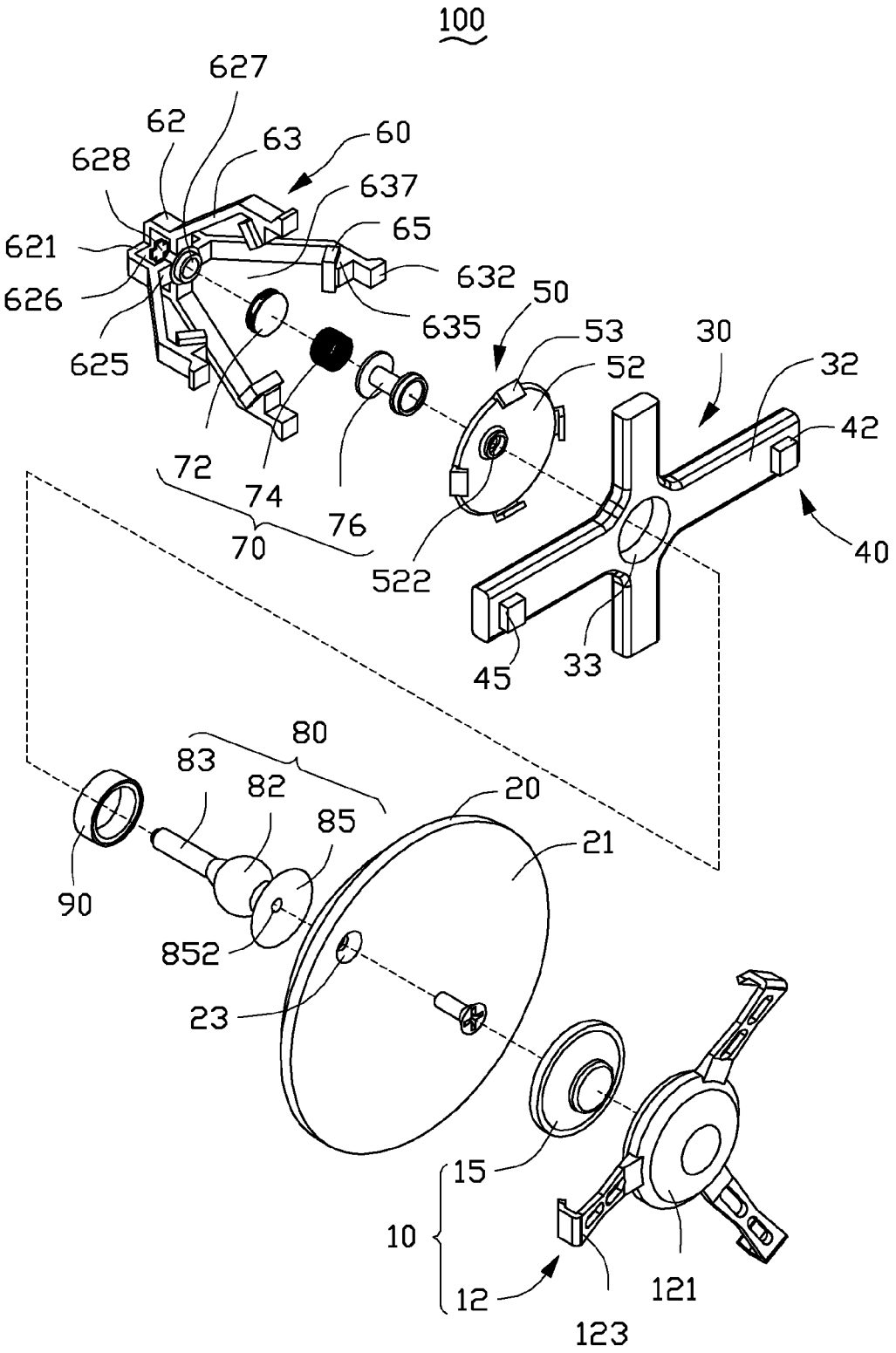
FIG. 1 is an exploded, isometric view of an embodiment of a loudspeaker.
Figure 2:
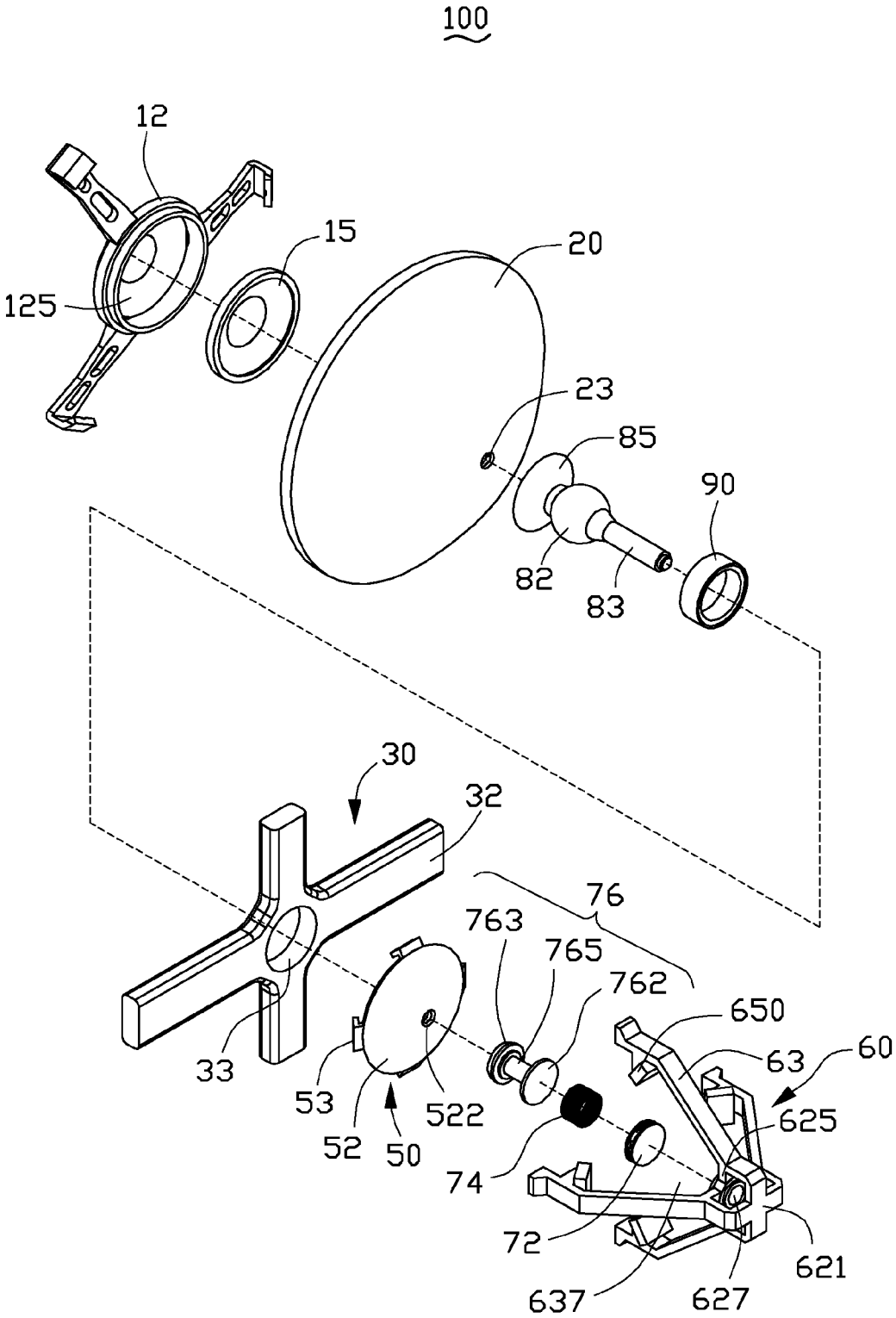
FIG. 2 is similar to FIG. 1, but viewed from another perspective.

FIGS. 1 and 2 show an embodiment of a loudspeaker 100 including a sound generator 10, a sound-reflecting member 20, a base 30, a controlling apparatus 40, an adjusting member 50, a supporting member 60, a positioning apparatus 70, a connecting member 80, and a ring 90.

The sound generator 10 includes a mounting bracket 12 and an electromagnetic actuator 15. The mounting bracket 12 includes a bowl 121 and a plurality of connecting hooks 123 slantingly extending out from a circumference of the bowl 121. An inner surface of the bowl 121 defines a latching hole 125 for receiving the electromagnetic actuator 15. The electromagnetic actuator 15 is configured for generating sound.

The sound-reflecting member 20 is substantially dish-shaped and made of acoustic resistant material. An inner surface of the sound-reflecting member 20 is a sound-reflecting surface 21. An area of the sound-reflecting surface 21 is greater than an area of an outer surface of the electromagnetic actuator 15 opposite to the reflecting surface 21. A through hole 23 is axially defined in the sound-reflecting member 20.

The base 30 is substantially cross-shaped and includes two positioning arms 32 connected substantially perpendicularly to each other. A junction of the positioning arms 32 defines a receiving hole 33.

The controlling apparatus 40 includes a monitoring apparatus 42 and a controller 45. The monitoring apparatus 42 and the controller 45 are mounted on two opposite ends of one of the positioning arms 32, respectively. The monitoring apparatus 42 and the sound-reflecting member 20 face a same direction. The monitoring apparatus 42 is configured for capturing images in front of the sound-reflecting member 20. The controller 45 is electrically coupled to the monitoring apparatus 42.

The adjusting member 50 includes a substantially hemispherical adjusting piece 52 and a plurality of magnetic pieces 53 extending from a circumference of the adjusting piece 52. In one embodiment, each magnetic piece 53 is made of iron, and each magnetic piece 53 extends slantingly from the circumference of the adjusting piece 52 toward a center of the adjusting piece 52. The center of the adjusting piece 52 axially defines a mounting hole 522.

The supporting member 60 includes a shell 62, four supporting arms 63 extending slantingly out from four sides of the shell 62, and four first electromagnets 65. The shell 62 includes a substantially cross-shaped back plate 621 and a substantially cross-shaped middle plate 625 opposite to and spaced from the back plate 621. Angles defined between the supporting poles 63 and the middle plate 625 are obtuse angles and are substantially the same. The back plate 621 and the middle plate 625 cooperatively bound a receiving space 626. A middle of the middle plate 625 defines a guiding hole 627 communicating with the receiving space 626. An installing portion 628 protrudes into the receiving space 626 from the back plate 621. Each supporting pole 63 includes a connecting portion 632 at a distal end thereof and a tab 635. The tab 635 is adjacent to the connecting portion 632 and extends toward a tab 635 of an opposite supporting arm 63. The first electromagnets 65 are mounted to the tabs 635 to face the shell 62. The supporting poles 63 cooperatively bound an adjustment space 637.

The positioning apparatus 70 includes a second electromagnet 72, a resilient member 74, and a positioning member 76. The positioning member 76 includes a connecting block 762, a positioning portion 763 opposite to the connecting block 762, and a guiding pin 765 detachably connected between the connecting block 762 and the positioning portion 763. In one embodiment, the positioning portion 763 is made of pliable material, such as pliable plastic, the resilient member 74 is a spring, and the connecting block 762 is made of iron. The controller 45 is electrically coupled to the first electromagnets 65 and the second electromagnet 72.

The connecting member 80 includes a spherical rotating portion 82, a connecting pole 83 protruding out from a first side of the rotating portion 82, and a mounting portion 85 protruding out from a second side of the rotating portion 82 opposite from the first side. A middle part of the mounting portion 85 defines an installing hole 852 extending along an axial direction of the connecting pole 83.

Figure 3:
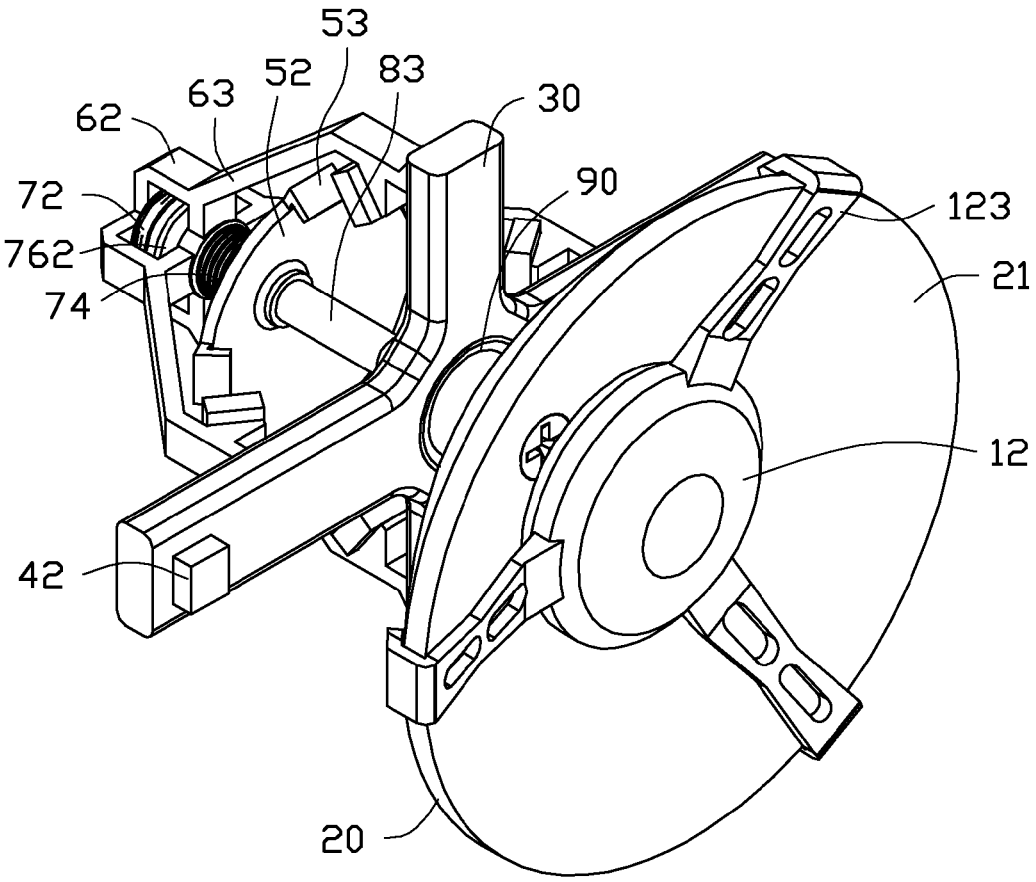
FIG. 3 is an assembled, isometric view of the loudspeaker of FIG. 1.
Figure 4:
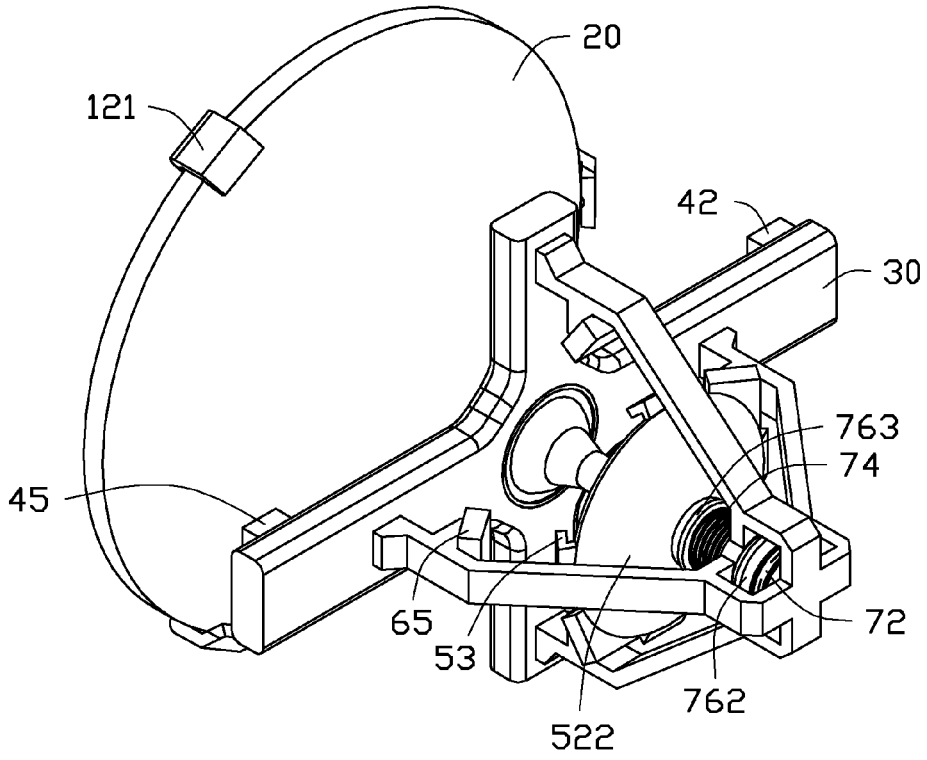
FIG. 4 is an assembled, isometric view of the loudspeaker of FIG. 2.

FIGS. 3 and 4 show that in assembly of the loudspeaker 100, the second electromagnet 72 is received in the receiving space 626 and mounted to the installing portion 628 of the back plate 621. The connecting block 762 is detached from the guiding pin 765 and received in the receiving space 626. The resilient member 74 is sleeved around the guiding pin 765. The guiding pin 765 is partially received in the guiding hole 627 from the adjustment space 637, such that the positioning portion 763 remains outside the guiding hole 627. The part of the guiding pin 765 received in the guiding hole 627 is mounted to the connecting block 762. The resilient member 74 is resiliently sandwiched between the positioning portion 763 and the middle plate 625 to bias the connecting block 762 away from the second electromagnet 72. The ring 90 is securely received in the receiving hole 33 of the base 30. The connecting pole 83 of the connecting member 80 is received through an interior space of the ring 90, until the rotating portion 82 is rotatably received in the ring 90, and the mounting portion 85 is located at a same side of the positioning arms 32 as the monitoring apparatus 42. The connecting pole 83 is latched in the mounting hole 522 of the adjusting member 50, and the magnetic pieces 53 face the base 30. An outer surface of the sound-reflecting member 20 opposite from the sound-reflecting surface 21 is attached to the mounting portion 85, such that the through hole 23 is aligned with the installing hole 852. A screw is received through the through hole 23 and is screwed in the installing hole 852 to secure the sound-reflecting member 20 to the mounting portion 85 of the connecting member 80. The connecting portions 632 of the supporting member 60 are mounted to the positioning arms 32 of the base 30, such that the adjusting member 50 is received in the adjustment space 637 of the supporting member 60. Thus, the first electromagnets 65 align with the magnetic pieces 53 of the adjusting member 50, the positioning portion 763 engages with the adjusting member 50 to position the sound-reflecting member 20, and the connecting block 762 is spaced from the second electromagnet 72. The electromagnetic actuator 15 is received in the latching hole 125 of the mounting bracket 12, such that the electromagnetic actuator 15 faces the sound-reflecting surface 21. The connecting hooks 123 are latched around a circumference of the sound-reflecting member 20 sound-reflecting.

Figure 5:
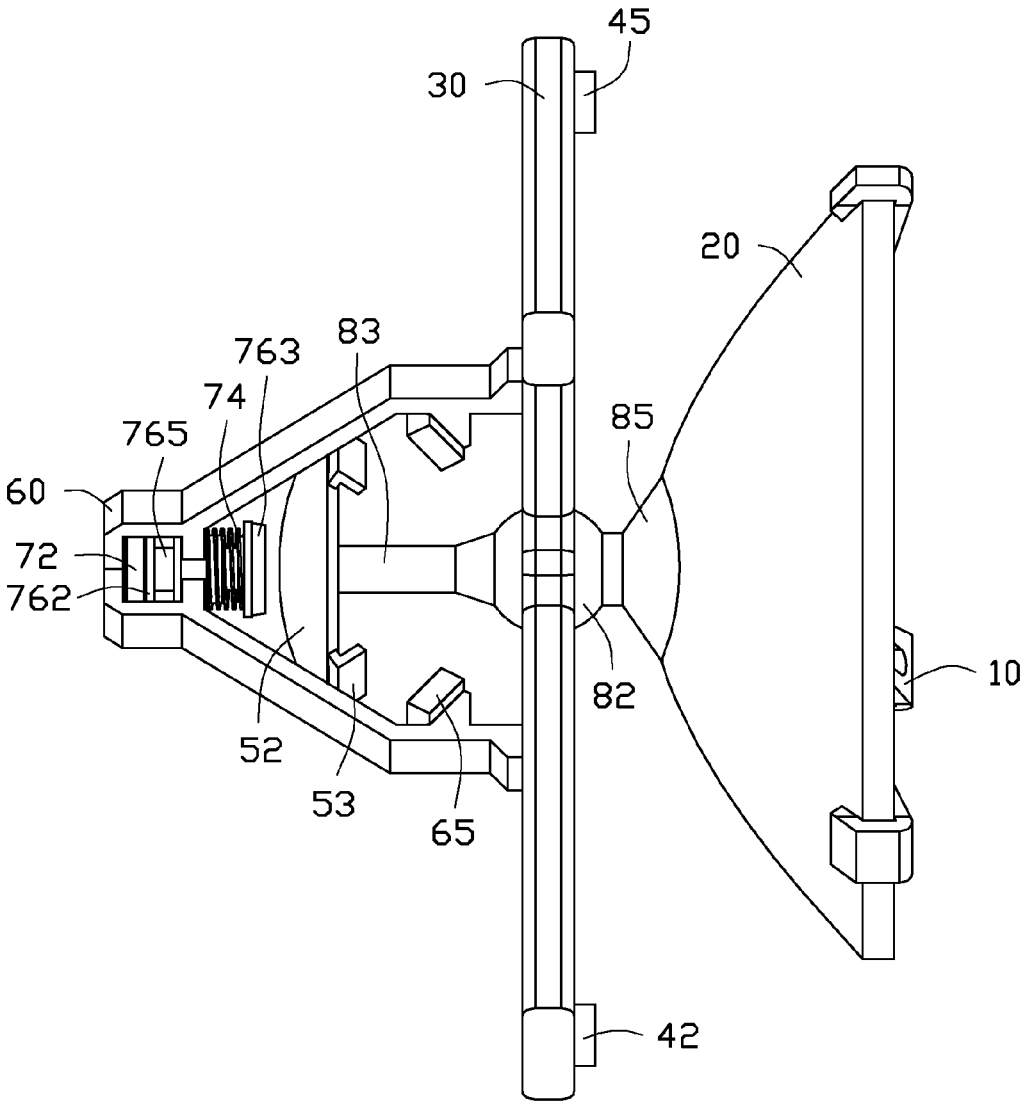
FIG. 5 is a side plan view of FIG. 3.
Figure 6:
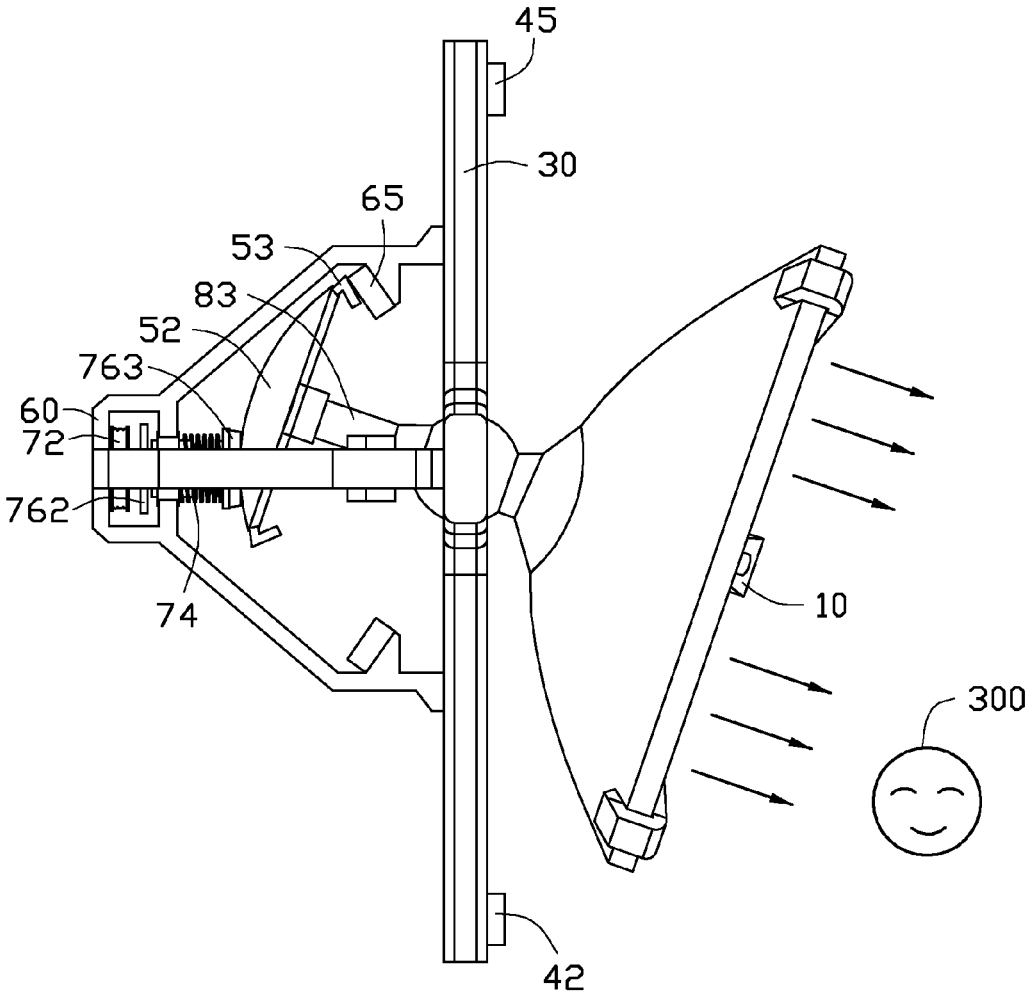
FIG. 6 is similar to FIG. 5, but shows the loudspeaker in a state of use.

FIGS. 5 and 6 show that in use, the sound generator 10 generates sound for a user 300. The monitoring apparatus 42 captures images of the user 300 and transmits the images to the controller 45. The controller 45 recognizes a human face from the images. The controller 45 controls the second electromagnet 72 to switch on a power supply. When the second electromagnet 72 is turned on, the connecting block 762 is attracted to the second electromagnet 72, causing the guiding pin 765 to slide along the guiding hole 627 of the middle plate 625 and deform the resilient member 74. As a result, the positioning portion 763 is detached from the adjusting member 50. Then, the controller 45 controls one or more of the first electromagnets 65 to switch on or off a power supply, causing one or more corresponding magnetic pieces 53 to be attracted to the first electromagnets 65, which further causes the adjusting member 50 to swing. The connecting member 80 is rotated by the adjusting member 50, and the sound-reflecting member 20 is swung by the connecting member 80, such that the sound-reflecting member 20 points to the user 300. Therefore, an angle of the sound-reflecting member 20 and the base 30 is adjusted, and sound generated by the sound generator 10 is broadcasted toward the user 300. The controller 45 controls the second electromagnet 72 to switch off the power supply, causing the resilient member 74 to restore to drive the positioning member 76 to move back toward the adjusting member 50. The connecting block 762 is detached from the second electromagnet 72, and the positioning portion 763 engages with the adjusting member 50 to securely hold the sound-reflecting member 20 in position.

It is to be understood, that even though numerous characteristics and advantages of the embodiment have been set forth in the foregoing description, together with details of the structure and function of the embodiment, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A loudspeaker, comprising:

a base;

a sound-reflecting member located at a side of the base;

a sound generator mounted to the sound-reflecting member;

an adjusting member located at an opposite side of the base, the adjusting member comprising a plurality of magnetic pieces;

a connecting member rotatably extending through the base, and connecting the sound-reflecting member and the adjusting member;

a supporting member comprising a plurality of first electromagnets mounted to the plurality of magnetic pieces; and a controlling apparatus electrically coupled to the plurality of first electromagnets; wherein the controlling apparatus controls the plurality of first electromagnets to attract the plurality of magnetic pieces, to allow the adjusting member to swing, and the adjusting member drives the connecting member to rotate, thereby swinging the sound-reflecting member, to adjust an angle between the sound-reflecting member and the base.

2. The loudspeaker of claim 1, wherein the base defines a receiving hole, the connecting member comprises a rotating portion rotatably received in the receiving hole, a connecting pole protruding out from the rotating portion and mounted to the adjusting member, and a mounting portion protruding out from the rotating portion and mounted to the sound-reflecting member.

3. The loudspeaker of claim 2, wherein the rotating portion is spherical.

4. The loudspeaker of claim 2, wherein a middle of the mounting portion defines an installing hole, a middle of the sound-reflecting member defines a through hole, a screw extends through the through hole and engages in the installing hole.

5. The loudspeaker of claim 2, wherein the adjusting member comprises an adjusting piece, the plurality of magnetic pieces is located at an edge of the adjusting piece.

6. The loudspeaker of claim 5, wherein the adjusting piece is hemispherical.

7. The loudspeaker of claim 5, wherein each magnetic piece slantingly extends out from the adjusting piece toward a middle of the adjusting piece.

8. The loudspeaker of claim 5, wherein a middle of the adjusting piece axially defines a mounting hole, the connecting pole is mounted in the mounting hole of the adjusting piece.

9. The loudspeaker of claim 5, wherein each magnetic piece is made of iron.

10. The loudspeaker of claim 5, wherein the supporting member comprises a shell and a plurality of supporting poles slantingly extending out from an edge of the shell, distal ends of the plurality of supporting poles are mounted to the base, the plurality of first electromagnets is mounted to portions of the plurality of supporting poles away from the shell, the plurality of supporting poles cooperatively bounds an adjustment space, the adjusting member is received in the adjustment space, and the plurality of magnetic pieces of the adjusting member aligns with the corresponding first electromagnets.

11. The loudspeaker of claim 10, further comprising a positioning apparatus, wherein the positioning apparatus comprises a second electromagnet, a positioning member, and a resilient member, the shell comprises a back plate and a middle plate opposite to and spaced from the back plate, the back plate and the middle plate cooperatively bound a receiving space, the middle plate defines a guiding hole communicating with the receiving space, the second electromagnet is received in the receiving space and mounted to the back plate, the positioning member is slidably installed in the guiding hole of the middle plate, the resilient member is resiliently sandwiched between the positioning member and the middle plate, the resilient member biases the positioning member to position the adjusting member, the controlling apparatus comprises a controller electrically coupled to the second electromagnet, the controller controls the second electromagnet to attract or detach from the positioning member.

12. The loudspeaker of claim 11, wherein the positioning member comprises a connecting block received in the receiving space of the shell and aligning with the second electromagnet, a positioning portion received in the adjustment space, and a guiding pin slidably received in the guiding hole of the middle plate, the guiding pin is connected between the positioning portion and the connecting block.

13. The loudspeaker of claim 12, wherein the positioning portion is made of pliable material.

14. The loudspeaker of claim 12, wherein the connecting block is made of iron.

15. The loudspeaker of claim 11, wherein the controlling apparatus further comprises a monitoring apparatus electrically coupled to the controller, the monitoring apparatus and the sound-reflecting member point to the same direction, the monitoring apparatus is configured for capturing images in front of the monitor, and transmits the images to the controller.

16. The loudspeaker of claim 1, wherein the sound-reflecting member is horn-shaped, and an inner surface of the sound-reflecting member forms a sound-reflecting surface facing the sound generator.

* * * * *